US011138951B2

(12) United States Patent
Ko

(10) Patent No.: US 11,138,951 B2
(45) Date of Patent: Oct. 5, 2021

(54) ELECTRONIC DEVICE INCLUDING NON-FLAT DISPLAY SURFACE AND IMAGE DISPLAY METHOD THEREOF

(71) Applicant: Acer Incorporated, New Taipei (TW)

(72) Inventor: Chueh-Pin Ko, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 16/823,326

(22) Filed: Mar. 18, 2020

(65) Prior Publication Data

US 2021/0201842 A1 Jul. 1, 2021

(30) Foreign Application Priority Data

Dec. 31, 2019 (TW) ..... 108148614

(51) Int. Cl.
*G09G 5/00* (2006.01)
*G09G 5/373* (2006.01)

(52) U.S. Cl.
CPC ..... *G09G 5/005* (2013.01); *G09G 5/373* (2013.01); *G09G 2310/0232* (2013.01); *G09G 2340/14* (2013.01)

(58) Field of Classification Search
None
See application file for complete search history.

(56) References Cited

U.S. PATENT DOCUMENTS

2013/0076649 A1* 3/2013 Myers ..... G06F 3/0485 345/173
2015/0177561 A1* 6/2015 Yoshida ..... G02F 1/133526 345/32
2016/0196778 A1* 7/2016 Cha ..... G09G 3/20 345/694
2016/0307973 A1 10/2016 Yang et al.
2018/0114474 A1 4/2018 Powell et al.
2018/0364758 A1 12/2018 Jin et al.

FOREIGN PATENT DOCUMENTS

CN 104124261 10/2014
CN 105741774 3/2018
CN 108598130 9/2018
TW 201905559 2/2019

* cited by examiner

*Primary Examiner* — Edward Martello
(74) *Attorney, Agent, or Firm* — JCIPRNET

(57) ABSTRACT

An electronic device including a non-flat display surface and an image display method thereof are provided. The method is adapted for the electronic device having the non-flat display surface, and a display device of the electronic device is disposed under a non-flat cover. A plurality of edge display pixels in an edge display region of the display device is grouped into at least one pixel group according to a tilt state of an edge of the non-flat cover. Image data is adjusted according to a quantity of the at least one pixel group, to drive a display panel to display according to the adjusted image data. The edge display pixels in the pixel group are configured to display a same image pixel.

12 Claims, 7 Drawing Sheets

ELECTRONIC DEVICE INCLUDING NON-FLAT DISPLAY SURFACE AND IMAGE DISPLAY METHOD THEREOF

CROSS-REFERENCE TO RELATED APPLICATION

This application claims the priority benefit of Taiwan application serial no. 108148614, filed on Dec. 31, 2019. The entirety of the above-mentioned patent application is hereby incorporated by reference herein and made a part of this specification.

BACKGROUND

Technical Field

The disclosure relates to an electronic device, and in particular, to an electronic device including a non-flat display surface and an image display method thereof.

Description of Related Art

With development of science and technology, a variety of electronic products with a display device, such as televisions, notebook computers, tablet computers, game consoles, and smartphones, have become an indispensable part of modern people. In addition to satisfying functional demands, the electronic products with the display device are being developed to have beautiful appearances in design. For example, narrow-bezel appearance designs are used in existing electronic products to catch consumers' eye or help satisfy a splicing demand of a display. In the current technology, a narrow-bezel appearance design can be achieved by designing the display device with a narrow bezel. However, making an electronic product present a bezel-less display effect is a further objective for which a person skilled in the art currently makes efforts.

Currently, to achieve a bezel-less display effect, an edge of an optical cover covering the display device may be bent or cut in design. Therefore, after being refracted by the optical cover, light emitted from an edge display region of a display panel is transmitted to a user, so that the user can experience a bezel-less visual effect. Furthermore, the edge of the display panel may also be bent to fit to the non-flat optical cover to make a display effect of the display device more magnificent, and the user can view displayed content regardless of whether the user views the display device from the front or the side. However, when the user views the display devices having a non-flat display surface from the front, picture distortion occurs on the edge of the display region in response to inclination and bending of the edge of the optical cover and/or the display panel. Consequently, there is a problem of poor visual experience.

SUMMARY

In view of this, the invention provides an electronic device including a non-flat display surface and an image display method thereof to resolve the foregoing problem of distortion on an edge of a frame, thereby improving visual experience of a user during viewing a display device.

An embodiment of the invention provides an image display method. The method is adapted for an electronic device including a non-flat display surface, where a display device of the electronic device is disposed under a non-flat cover. The method includes the following steps: grouping a plurality of edge display pixels in an edge display region of the display device into at least one pixel group according to a tilt state of an edge of the non-flat cover; and adjusting image data according to a quantity of the at least one pixel group to drive a display panel to display according to the adjusted image data. The edge display pixels in the pixel group are configured to display a same image pixel.

An embodiment of the invention provides an electronic device including a non-flat display surface, where the electronic device includes a non-flat cover and a display device. The display device is disposed under a non-flat cover, and includes a display panel and an image processing circuit. The image processing circuit is coupled to the display panel. The image processing circuit groups a plurality of edge display pixels in an edge display region of the display device into at least one pixel group according to a tilt state of an edge of the non-flat cover. The image processing circuit adjusts image data according to a quantity of the at least one pixel group to drive the display panel to display according to the adjusted image data. The edge display pixels in the pixel group are configured to display a same image pixel.

Based on the foregoing, in the embodiments of the invention, the plurality of edge display pixels in the edge display region of the display panel may be grouped into at least one pixel group, and each edge display pixel in the one or more pixel groups are configured to display a same image pixel. In other words, the image processing circuit of the display device can drive each edge display pixel in a pixel group to display according to a same image pixel in the adjusted image data. In this way, when a user views the electronic device from the front, the user can experience a bezel-less visual effect, and displayed content in the edge display region is not distorted.

To make the features and advantages of the invention more comprehensible, a detailed description is made below with reference to the accompanying drawings by using embodiments.

DESCRIPTION OF THE EMBODIMENTS

Some embodiments of the invention will be described below in detail with reference to accompanying drawings.

For element symbols cited in the following descriptions, a same element symbol appearing in different accompanying drawings is considered as a same element or a similar element. The embodiments are a part of the invention, and do not disclose all implementations of the invention. More precisely, the embodiments are merely examples of the method and the device in the patent application scope of the invention.

Figure 1:
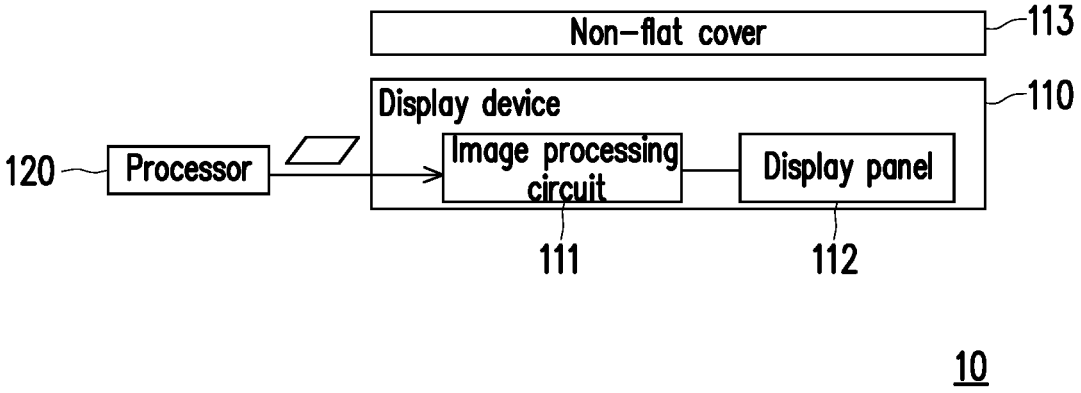
FIG. 1 is a block diagram of an electronic device according to an embodiment of the invention.

FIG. 1 is a block diagram of an electronic device according to an embodiment of the invention. This is merely for ease of description, and is not intended to limit the invention. Referring to FIG. 1, an electronic device 10 in an embodiment of the invention may be implemented as an electronic product having a display function, such as a stand-alone display, a television, a notebook computer, a tablet computer, a mobile phone, or a display board. The electronic device 10 including a non-flat display surface includes a non-flat cover 113 and a display device 110. The display device 110 is disposed under the non-flat cover 113.

Specifically, the non-flat cover 113 completely covers the display device 110, and a display panel 112 of the display device 110 may be attached to the non-flat cover 113 through an adhesive material. The non-flat cover 113 is an optical cover, and for example, may be made from glass, acrylic (polymethyl methacrylate), plastic (for example, polycarbonate), or the like. It should be specially noted that, in the present embodiment of the invention, at least one edge of the non-flat cover 113 is a curved surface or a slope. In an embodiment, a center region of the non-flat cover 113 is a flat surface, and an edge region on two sides or a periphery of the non-flat cover 113 is a non-flat surface. For example, the non-flat cover 113 may be a 2.5D glass cover or a 3D glass cover, and an edge of the cover is arc-shaped in design.

In the present embodiment, the display device 110 may include a display panel 112 and an image processing circuit 111. In an embodiment, the display panel 112 may be equipped with a flexible display substrate and therefore, has a property of flexibility. For example, the display panel 112 may be implemented as an organic light-emitting diode (OLED) panel, a mini light-emitting diode (Mini LED) panel, a micro light-emitting diode (micro LED) panel, a liquid-crystal display (LCD) panel, or the like. This is not limited in the invention. The display panel 112 includes a plurality of display pixels arranged in array. For example, the display panel 112 may include 1920*1080 display pixels, but the invention is not limited thereto.

The image processing circuit 111 is coupled to the display panel 112, and may be configured to perform image processing, for example, processing on an image contrast, an image brightness, an image color or the like, or image processing, such as resolution adjustment, in image processing in an image processing process. In addition, the image processing circuit 111 is configured to drive the display panel 112 to display. For example, the image processing circuit 111 may include a scalar, a timing controller, and a circuit configured to perform another image processing function. The image processing circuit 111 may be implemented by using one or more integrated circuit chips. This is not limited in the invention. In the present embodiment, the image processing circuit 111 may receive image data including a plurality of image pixels, to enable the display panel 112 to display corresponding frame content.

In an embodiment, the electronic device 10 may further include a processor 120, to provide a function, other than a display function, to a user. The processor 120 may be, for example, a central processing unit (CPU), a graphic processing unit (GPU), another programmable general-purpose or special-purpose microprocessor, a digital signal processor (DSP), an image signal processor (ISP), a programmable controller, an application-specific integrated circuit (ASIC), a programmable logic device (PLD), or other similar devices or a combination of the devices.

Figure 2:
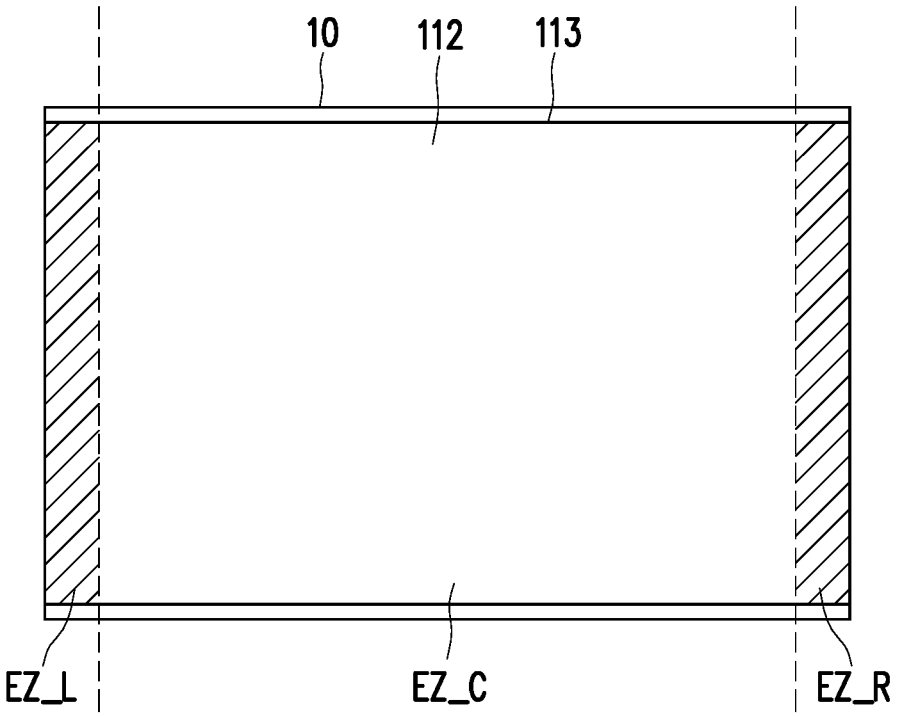
FIG. 2 is a schematic front view of an electronic device according to an embodiment of the invention.

FIG. 2 is a schematic front view of an electronic device according to an embodiment of the invention. Referring to FIG. 2, the non-flat cover 113 covers the display panel 112. In the example, when a bezel-less display effect is provided for two side edges of the electronic device 10, cover edges of the non-flat cover 113 on two opposite sides are non-flat surfaces, for example, curved surfaces or slopes that extend downward. As shown in FIG. 2, display regions of the display panel 112 include a center display region EZ_C and edge display regions EZ_L and EZ_R corresponding to non-flat parts of the non-flat cover 113. However, FIG. 2 is merely an illustrative description, but is not intended to limit the invention. In other embodiments, when the bezel-less display effect is provided for a single side edge or a plurality of side edges of the electronic device 10, an edge of a single side or edges of four sides of the non-flat cover 113 may be non-flat surfaces and may be designed according to actual demands. However, for ease of description of the invention, description is continued by using an example in which edges of the two opposite sides of the non-flat cover 113 are non-flat surfaces as an example.

Figure 3A:
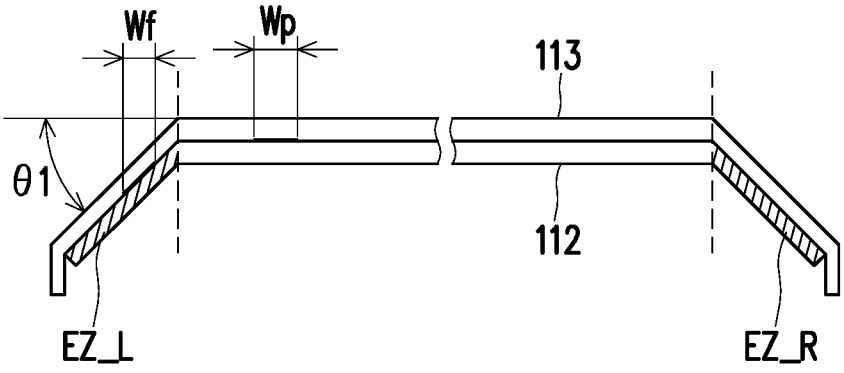
FIG. 3A is a schematic cross-sectional view of a non-flat cover and a display panel according to an embodiment of the invention.

FIG. 3A is a schematic cross-sectional view of a non-flat cover and a display panel according to an embodiment of the invention. Referring to FIG. 3A, in the present embodiment, two sides of the non-flat cover 113 include non-flat edges that extend downward obliquely. In the present example, tilt states of cover edges of the non-flat cover 113 are completely consistent, and the cover edges are referred to as slope edges. In the present example, it is assumed that display pixels of the display panel 112 are spaced at a preset pixel pitch Wp. However, when a user views the display panel 112 from the front (a sight line is approximately perpendicular to the center display region of the display panel 112), because the cover edges and the edge display regions EZ_L and EZ_R of the display panel 112 are designed to be non-flat surfaces, for the user, edge display pixels of the edge display regions EZ_L and EZ_R of the display panel 112 are spaced at a front-view pixel pitch Wf. As shown in FIG. 3A, the front-view pixel pitch Wf depends on a surface tilt angle θ1 and is less than the preset pixel pitch Wp. As can be known, when the user views, from the front, the display panel 112 covered by the non-flat cover 113, there is a phenomenon of frame distortion in which displayed content in the edge display regions EZ_L and EZ_R on the two sides of the display panel 112 is extruded.

Figure 3B:
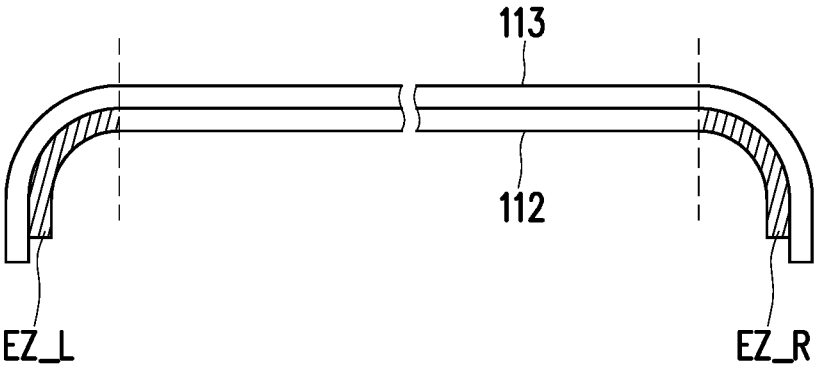
FIG. 3B is a schematic cross-sectional view of a non-flat cover and a display panel according to an embodiment of the invention.

FIG. 3B is a schematic cross-sectional view of a non-flat cover and a display panel according to an embodiment of the invention. Referring to FIG. 3B, in the present embodiment, two sides of the non-flat cover 113 include non-flat edges that extend downward in a bending manner. In the present example, tilt states of cover edges of the non-flat cover 113 are inconsistent, where the cover edges are referred to as rounded edges. It can be learned from the foregoing descriptions that, when a user views the display panel 112 from the front view, because the cover edges and the edge display regions EZ_L and EZ_R of the display panel 112 are designed to be non-flat surfaces, for the user, edge display pixels of the edge display regions EZ_L and EZ_R of the display panel 112 are spaced at a front-view pixel pitch that is gradually decreased outwardly. A front-view pixel pitch on an outermost side is the smallest. As can be known, when the user views, from the front, the display panel 112 covered by the non-flat cover 113, there is a phenomenon of frame distortion in which displayed content in the edge display regions EZ_L and EZ_R on the two sides of the display panel 112 is extruded.

Regardless of whether the non-flat cover 113 is designed with a slope in FIG. 3A or a rounded edge design in FIG. 3B, in the present embodiment of the invention, the image processing circuit 111 may group, according to the tilt states of the edges of the non-flat cover 113, a plurality of edge display pixels in the edge display regions EZ_L and EZ_R of the display device 110 into at least one pixel group. In an embodiment, the tilt states of the edges of the non-flat cover 113 may be digitized into a plurality of values and are recorded in a storage element of the image processing circuit 111. In other words, after the non-flat design of the non-flat cover 113 is determined, the tilt states of the cover edges of the non-flat cover 113 are known and fixed, and therefore, value data representing the tilt states may be recorded in the storage element of the image processing circuit 111. In this case, a plurality of edge display pixels of the edge display regions EZ_L and EZ_R may be grouped into one or more pixel groups according to the data in the storage element.

Subsequently, the image processing circuit 111 may adjust image data according to a quantity of the pixel groups, to drive the display panel 112 to display according to the adjusted image data. It should be specially noted that, the edge display pixels in the pixel group are configured to display a same image pixel. That is, the edge display pixels in the same pixel group are driven to display a same image pixel in the image data. More specifically, a plurality of edge display pixels is grouped into one or more pixel groups, so that a front-view pixel pitch between a pixel group and an adjacent display pixel (or another pixel group) may approach a preset pixel pitch, to decrease a distortion degree of an edge of a frame. It should be noted that, in an embodiment, when the edge display pixels in the pixel group are configured to display a same image pixel, the image processing circuit 111 may drive edge display pixels in a pixel group to display according to a same pixel value, and may alternatively drive edge display pixels in a pixel group to display according to different pixel values. In other words, when the image processing circuit 111 drives edge display pixels in a pixel group to display according to different pixel values, the edge display pixel in a pixel group may be considered as subpixel units configured to display the image pixel.

Specifically, in an embodiment, the tilt states of the edges of the non-flat cover 113 include surface tilt angles respectively corresponding to the edge display pixels. Using FIG. 3A as an example, the edge display pixels in the edge display regions EZ_L and EZ_R of the display panel 112 correspond to a same surface tilt angle. Using FIG. 3B as an example, the edge display pixels in the edge display regions EZ_L and EZ_R of the display panel 112 correspond to a variable surface tilt angle. In this case, a surface tilt angle corresponding to an edge display pixel represents an angle (for example, an angle θ1 in FIG. 3A) between a surface of the non-flat cover 113 located right above the edge display pixel and a reference horizontal plane (parallel to a surface of a center display region of the non-flat cover 113).

In an embodiment, the edge display pixels may include a first edge display pixel and a second edge display pixel arranged along an X-axis direction. That is, the first edge display pixel and the second edge display pixel are display pixels in a same row. When the surface tilt angle corresponding to the first edge display pixel satisfies a grouping condition, the first edge display pixel and the second edge display pixel adjacent to the first edge display pixel are grouped into a pixel group. In contrast, when the surface tilt angle corresponding to the first edge display pixel does not satisfy the grouping condition, the first edge display pixel is not grouped with another edge display pixel.

In an embodiment, the grouping condition used to determine whether the edge display pixels are grouped may include that a cosine value of the surface tilt angle corresponding to the first edge display pixel is less than a threshold. That is, when the cosine value of the surface tilt angle corresponding to the first edge display pixel is less than the threshold, the first edge display pixel and the adjacent second edge display pixel is grouped into a pixel group. When the cosine value of the surface tilt angle corresponding to the first edge display pixel is not less than the threshold, the first edge display pixel is not grouped with another edge display pixel. However, in other embodiments, the grouping condition used to determine whether the edge display pixels are grouped may further include whether the surface tilt angle corresponding to the first edge display pixel is greater than an angle threshold.

In an embodiment, the edge display pixels may include a first edge display pixel, a second edge display pixel, and a third edge display pixel arranged along an X-axis direction. When a sum of the cosine value of the surface tilt angle corresponding to the first edge display pixel and a cosine value of the surface tilt angle corresponding to the second edge display pixel is less than the threshold, the first edge display pixel, the second edge display pixel adjacent to the first edge display pixel, and the third edge display pixel is grouped into the at least one pixel group.

That is, a quantity of the edge display pixel in the pixel group is determined according to a tilt degree of cover edges of the non-flat cover 113 and a threshold. The threshold may be adjusted according to actual requirements, and is, for example, 0.7, 0.6, . . . , and the like. In addition, in an embodiment, another threshold greater than 1, for example, 1.2 or 1.3, may be set, to prevent an excessively large quantity of edge display pixels from being grouped into a single pixel group.

The following describes the non-flat cover 113 having a slope edge and a rounded edge below in detail by enumerating embodiments.

Figure 4:
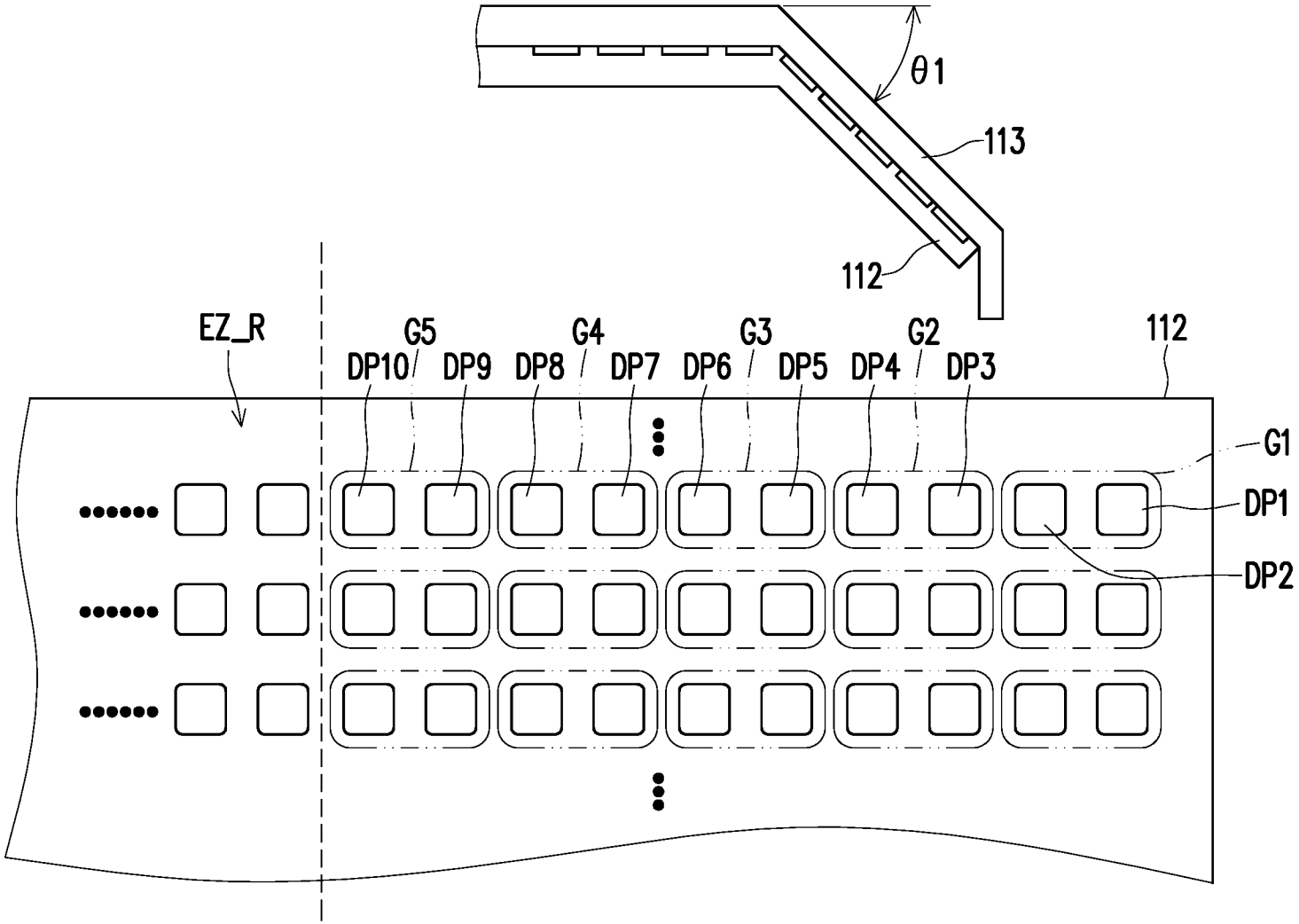
FIG. 4 is a schematic diagram of a pixel group according to an embodiment of the invention.

FIG. 4 is a schematic diagram of a pixel group according to an embodiment of the invention. Referring to FIG. 4, an example in which the non-flat cover 113 has a slope edge is used. It is assumed that a surface of a cover edge of the non-flat cover 113 extends downward obliquely and forms an angle θ1 (θ1=60°) with a center surface of the cover, and correspondingly, an edge display region EZ_R includes 10 edge display pixels DP1 to DP10 in a row. In the present embodiment, the image processing circuit 111 may group the edge display pixels DP1 to DP10 into the edge display region EZ_R according to Table 1. Referring to Table 1 and FIG. 4, surface tilt angles corresponding to the edge display pixels DP1 to DP10 are all 60 degrees. Therefore, cosine values of the surface tilt angles corresponding to the edge display pixels DP1 to DP10 are all 0.5. It can be learned that, if a preset pixel pitch between the edge display pixels DP1 to DP10 is considered as one unit length, a cosine value of a surface tilt angle corresponding to each of the edge display pixels DP1 to DP10 may represent a front-view pixel pitch between the edge display pixels DP1 to DP10. That is, when the cosine value of the surface tilt angle corresponding to each of the edge display pixels DP1 to DP10 is 60 degrees, it represents that the front-view pixel pitch between the edge display pixels DP1 to DP10 is 0.5 unit length.

TABLE 1

| Display pixel | DP 10 | DP 9 | DP 8 | DP 7 | DP 6 | DP 5 | DP 4 | DP 3 | DP 2 | DP 1 |
|---|---|---|---|---|---|---|---|---|---|---|
| Surface tilt angle | 60° | 60° | 60° | 60° | 60° | 60° | 60° | 60° | 60° | 60° |
| Cosine value | 0.5 | 0.5 | 0.5 | 0.5 | 0.5 | 0.5 | 0.5 | 0.5 | 0.5 | 0.5 |
| Sum of cosine values | 0.5 + 0.5 | | 0.5 + 0.5 | | 0.5 + 0.5 | | 0.5 + 0.5 | | 0.5 + 0.5 | |

In this case, in the example of the present embodiment, when a cosine value of a surface tilt angle corresponding to the edge display pixel DP10 is less than a threshold, the edge display pixel DP10 and the edge display pixel DP9 are grouped into a pixel group G5. Then, in the example, a sum of the cosine value of the surface tilt angle corresponding to the edge display pixel DP10 and a cosine value of a surface tilt angle corresponding to the edge display pixel DP9 is greater than the threshold, and therefore, the pixel group G5 is defined to include the edge display pixel DP10 and the edge display pixel DP9. The threshold is a value less than 1, and may be designed according to actual requirements. In this case, the threshold may be set to, for example, 0.7.

By analogy, the edge display pixel DP8 and the edge display pixel DP7 are grouped into a pixel group G4, the edge display pixel DP6 and the edge display pixel DP5 are grouped into a pixel group G3, the edge display pixel DP4 and the edge display pixel DP3 are grouped into a pixel group G2, and the edge display pixel DP2 and the edge display pixel DP1 are grouped into a pixel group G1. Similarly, edge display pixels in other rows located above or under the edge display pixels DP1 to DP10 in the edge display region EZ_R may also be grouped in the same way.

In an example of FIG. 4, the edge display pixel DP10 and the edge display pixel DP9 in the pixel group G5 are configured to display a same image pixel in image data. It should be noted that, in an embodiment, the edge display pixel DP10 and the edge display pixel DP9 in the pixel group G5 may be driven to display a same pixel value, to display a same image pixel in the image data. For example, assuming that the pixel group G5 is configured to display an image pixel having an RGB pixel value (255, 255, 0) respectively in the image data, the image processing circuit 111 may drive the edge display pixel DP10 and the edge display pixel DP9 according to the same RGB pixel value (255, 255, 0), so that the edge display pixel DP10 and the edge display pixel DP9 can respectively present yellow. Alternatively, in an embodiment, the edge display pixel DP10 and the edge display pixel DP9 in the pixel group G5 may be driven to display different pixel values, to display a same image pixel in the image data. For example, assuming that the pixel group G5 is configured to display an image pixel having an RGB pixel value (255, 255, 0) respectively in the image data, the image processing circuit 111 may drive the edge display pixel DP10 and the edge display pixel DP9 respectively according to different RGB pixel values (255, 0, 0) and (0, 255, 0), so that a user can obtain a yellow visual effect when the user sees the edge display pixel DP10 and the edge display pixel DP9. Similarly, the edge display pixel DP8 and the edge display pixel DP7 in the pixel group G4 are configured to display another same image pixel in the image data, and so on.

Figure 5:
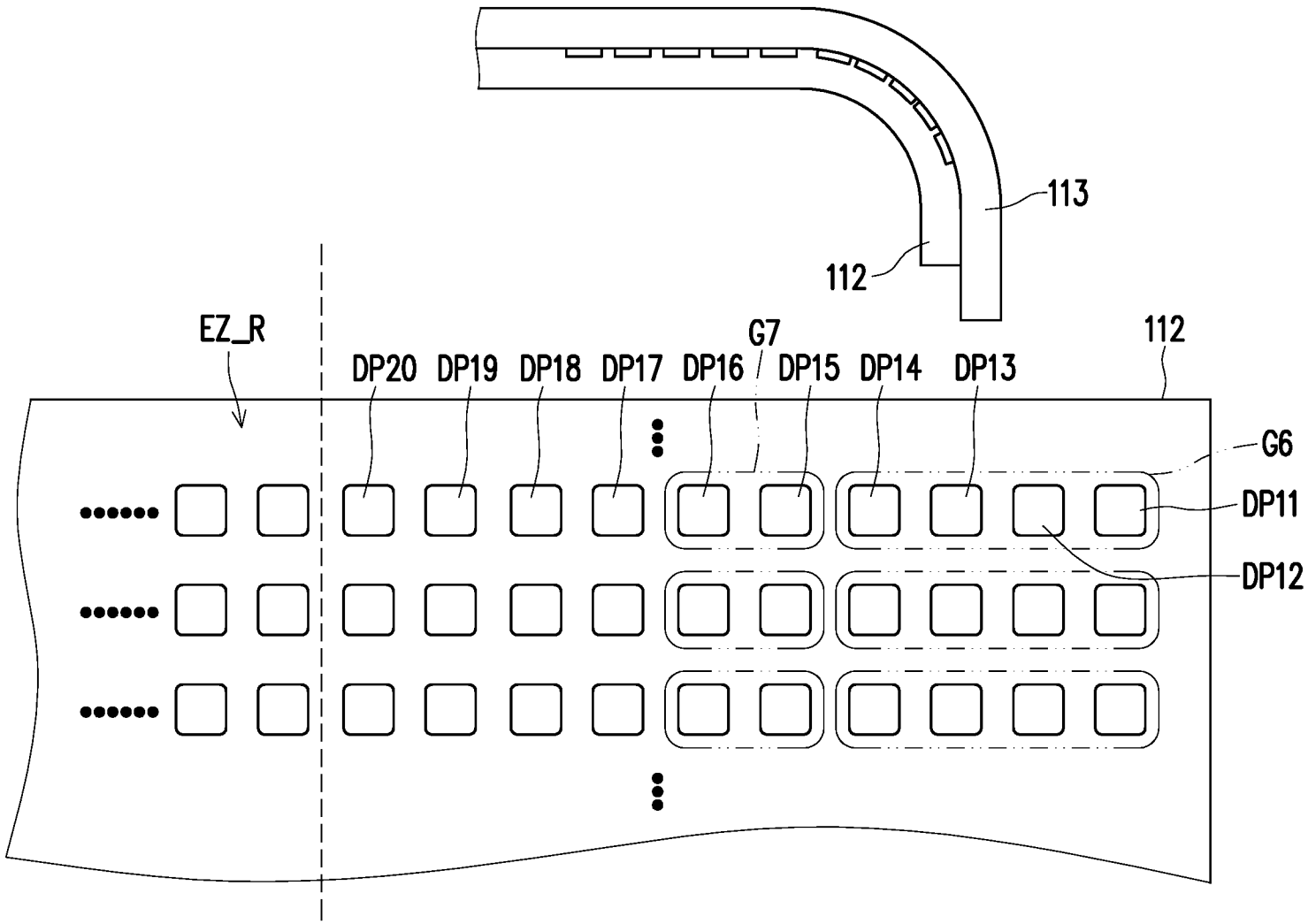
FIG. 5 is a schematic diagram of a pixel group according to an embodiment of the invention.

FIG. 5 is a schematic diagram of a pixel group according to an embodiment of the invention. Referring to FIG. 5, an example in which the non-flat cover 113 includes a rounded edge is provided. It is assumed that a surface of the cover edge of the non-flat cover 113 extends downward in a bending manner, and correspondingly, the edge display region EZ_R includes 10 edge display pixels DP11 to DP20 in a row. In the present embodiment, the image processing circuit 111 may group the edge display pixels DP11 to DP20 in the edge display region EZ_R according to Table 2. Referring to Table 2 and FIG. 5, surface tilt angles corresponding to the edge display pixels DP11 to DP20 have different angle values. Therefore, cosine values of the surface tilt angles corresponding to the edge display pixels DP11 to DP20 are shown in FIG. 2. It can be learned that, if a preset pixel pitch between the edge display pixels DP11 to DP20 is considered as one unit length, a cosine value of a surface tilt angle corresponding to each of the edge display pixels DP11 to DP20 may represent a front-view pixel pitch between the edge display pixels DP11 to DP20.

TABLE 2

| Display pixel | DP 20 | DP 19 | DP 18 | DP 17 | DP 16 | DP 15 | DP 14 | DP 13 | DP 12 | DP 11 |
|---|---|---|---|---|---|---|---|---|---|---|
| Surface tilt angle | 5° | 20° | 40° | 45° | 50° | 60° | 70° | 75° | 80° | 85° |
| Cosine value | 0.99 | 0.93 | 0.76 | 0.7 | 0.64 | 0.5 | 0.34 | 0.26 | 0.17 | 0.09 |
| Sum the of cosine values | 0.99 | 0.93 | 0.76 | 0.7 | 0.64 + 0.5 | | 0.34 + 0.26 + 0.17 + 0.09 | | | |

Referring to Table 2 and FIG. 5, in the example of the present embodiment, because a cosine value of a surface tilt angle corresponding to the edge display pixel DP20 is not less than a threshold, the edge display pixel DP20 is not grouped with another edge display pixel and serves as an independent edge display pixel. Similarly, the edge display pixels DP19, DP18, and DP17 are not grouped with another edge display pixel and serve as independent edge display pixels. However, when a cosine value of a surface tilt angle corresponding to the edge display pixel DP16 is less than the threshold, the edge display pixel DP16 and the edge display pixel DP15 is grouped into a pixel group G7.

It should be noted that, because a cosine value of a surface tilt angle corresponding to the edge display pixel DP11 is less than the threshold, the edge display pixel DP11 is grouped the edge display pixel DP12. Then, in the present example, because a sum of the cosine value of the surface tilt angle corresponding to the edge display pixel DP11 and a cosine value of a surface tilt angle corresponding to the edge display pixel DP12 is not greater than the threshold, the edge display pixel DP11, the edge display pixel DP12, the edge display pixel DP13, and the edge display pixel DP14 are grouped into a pixel group G6. The threshold is a value less than 1, and may be designed according to actual requirements. In this case, the threshold may be set to, for example, 0.7. By analogy, edge display pixels in other rows located above or under the edge display pixels DP11 to DP20 in the edge display region EZ_R may also be grouped in the same way.

In an example in FIG. 5, the edge display pixels DP11 to DP14 in the pixel group G6 are configured to display a same image pixel in image data. It should be noted that, in an embodiment, the edge display pixels DP11 to DP14 in the pixel group G6 may be driven according to a same RGB pixel value, to display a same image pixel in the image data. Alternatively, in an embodiment, the edge display pixel DP10 and the edge display pixel DP9 in the pixel group G5 may be driven according to different RGB pixel values, to display a same image pixel in the image data. Similarly, the edge display pixel DP16 and the edge display pixel DP15 in the pixel group G7 are configured to display another same image pixel in the image data. The edge display pixels DP17 to DP20 are respectively responsible for displaying different image pixels.

On the whole, in the embodiments of the invention, the image processing circuit 112 may group, according to the cosine values of the surface tilt angles corresponding to the edge display pixels, the edge display pixels into a plurality of pixel groups, to make a front-view pixel pitch between the grouped pixel groups (and independent edge display pixels) approach a preset pixel pitch in a flat display region. However, a quantity of pixels in each pixel group and the threshold may be adjusted according to actual requirements.

It may be learned from the foregoing descriptions that the edge display pixels in the edge display region may be grouped into a pixel group to display a same image pixel, and therefore, a quantity of effective display pixels in the edge display region decreases. In the embodiments of the invention, a sum of the quantity of the pixel groups and a quantity of at least one independent edge display pixel that is not grouped with another edge display pixel in the edge display pixels is equal to the quantity of the effective display pixels. In the example shown in FIG. 4, because there are five pixel groups, the quantity of the effective display pixels is equal to five. In the example shown in FIG. 5, because there are two pixel groups and four independent edge display pixels, the quantity of the effective display pixels is equal to six. Based on the above, the image processing circuit 113 needs to adjust the image data according to the quantity of the effective display pixels, to control display units whose quantity decreases in the edge display region to display. In other words, after the edge display pixels are grouped, a display resolution of the display panel 112 decreases.

In an embodiment, the image processing circuit 113 may carry out a first adjustment solution to only adjust image pixels corresponding to the edge display region. In another embodiment, the image processing circuit 113 may carry out the first adjustment solution to adjust image pixels of a whole image. In addition, in an embodiment, the processor 120 of the electronic device 10 may determine, according to the displayed content of the display device 110, to carry out one of the first adjustment solution and a second adjustment solution. Clear description is made below by enumerating embodiments.

Figure 6:
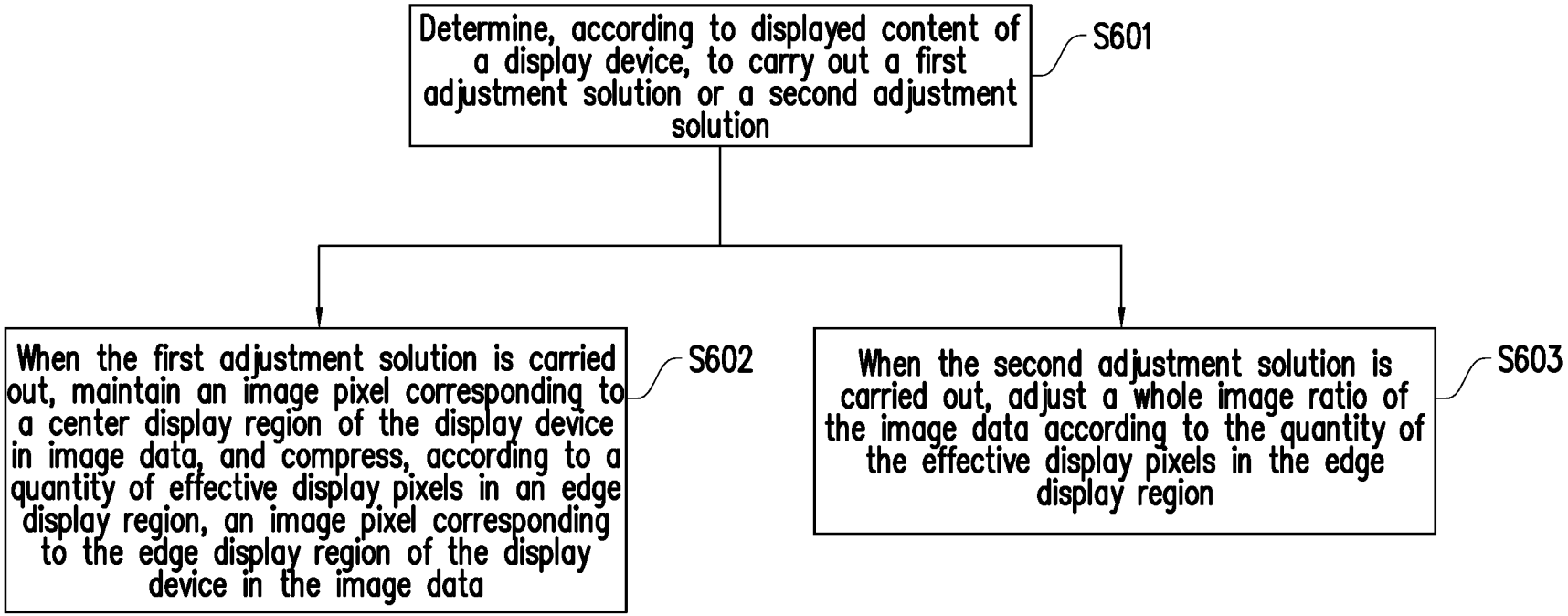
FIG. 6 is a flowchart of determining, according to displayed content, an adjustment solution according to an embodiment of the invention.

FIG. 6 is a flowchart of determining, according to displayed content, an adjustment solution according to an embodiment of the invention. Referring to FIG. 6, in step S601, a processor 120 determines, according to displayed content of the display device 110, to carry out a first adjustment solution or a second adjustment solution. For example, the processor 120 may control, according to an application currently executed by an electronic device 10, an image processing circuit 113 to carry out the first adjustment solution or the second adjustment solution.

In step S602, when carrying out the first adjustment solution, the image processing circuit 113 maintains an image pixel corresponding to a center display region of the display device 110 in image data, and compresses, according to a quantity of effective display pixels in an edge display region, an image pixel corresponding to the edge display region of the display device 110 in the image data.

For example, assuming that a preset resolution of a display panel 112 is 1920*1080 and a preset ratio of one edge display region on one side, a center display region, and the other edge display region on the other side is 3:94:3, it represents that an original resolution of each edge display region is approximately 58*1080, and an original resolution of the center display region is approximately 1804*1080. After the edge display pixels are grouped, assuming that the quantity of the effective display pixels in the edge display region is 29, it represents that a resolution of each edge display region is decreased to 29*1080, and a whole resolution of the display panel 112 is decreased to 1862*1080. In the first adjustment solution, when the display panel 112 needs to display an image including 1920*1080 image pixels, the image processing circuit 113 maintains 1804*1080 image pixels corresponding to the center display region, but respectively compresses 58*1080 image pixels corresponding to each of the edge display regions on the two sides into 29*1080 image pixels, to drive pixel groups in the edge display region of the display panel 112 and/or independent edge display pixels to display. It may be learned that, because the image pixels corresponding to the edge display regions of the display device 110 in the image data are compressed, content on an edge of a displayed frame is possibly lost, but a situation of distortion of an image does not occur.

Figure 7:
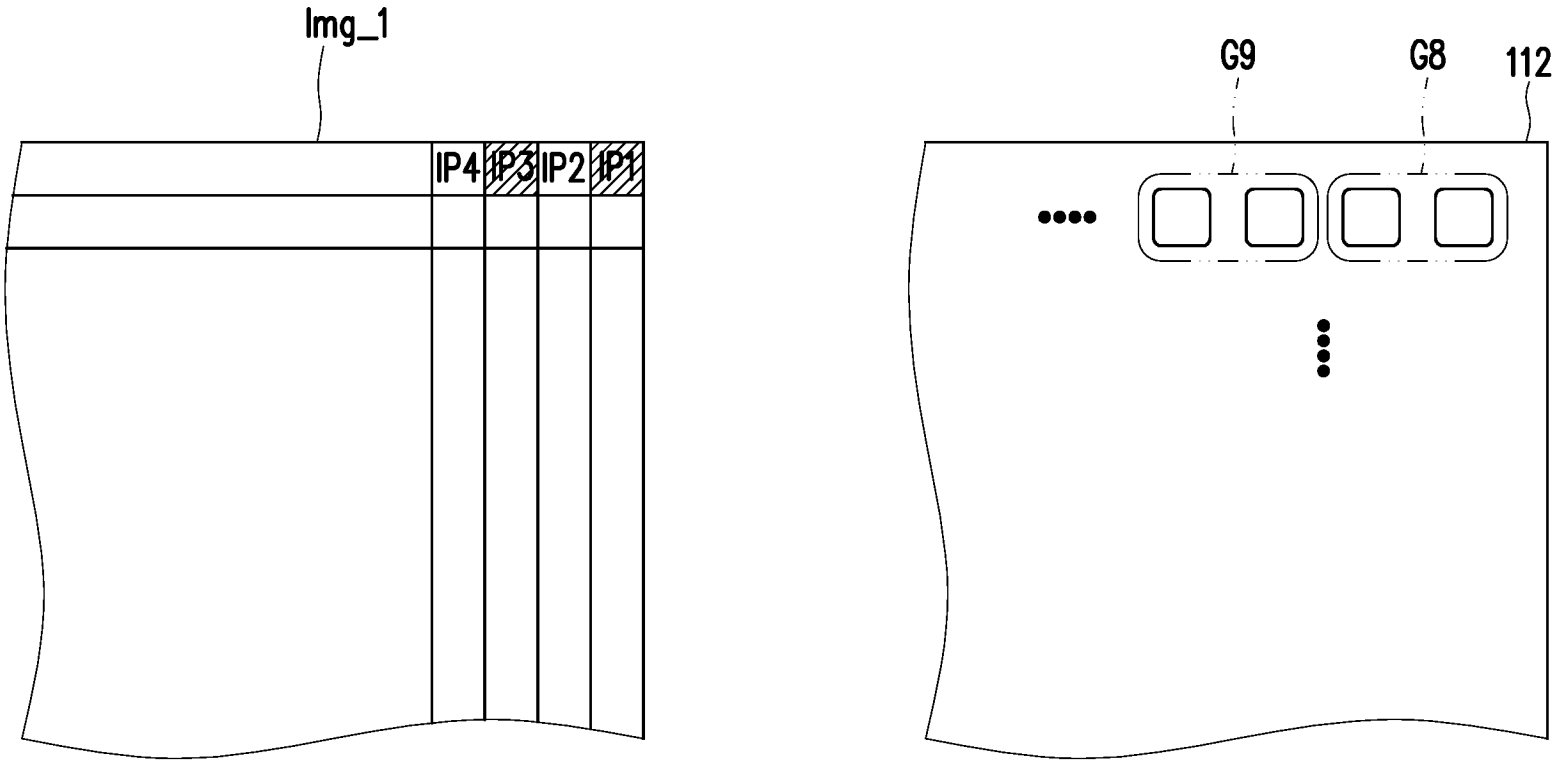
FIG. 7 is a schematic diagram of compressing an image pixel corresponding to an edge display region in image data according to an embodiment of the invention.

For example, FIG. 7 is a schematic diagram of compressing an image pixel corresponding to an edge display region in image data according to an embodiment of the invention. Referring to FIG. 7, edge display pixels in a pixel group G8 may be configured to display an image pixel IP2 in original image data Img_1, and an image pixel IP1 for displaying the original image data Img_1 is removed and is not displayed due to compression. Edge display pixels in a pixel group G9 may be configured to display an image pixel IP4 in the original image data Img_1, and an image pixel IP3 for displaying the original image data Img_1 is removed and is not displayed due to compression.

According to another aspect, in step S603, when carrying out the second adjustment solution, the image processing circuit 113 adjusts a whole entire image ratio of the image data according to the quantity of the effective display pixels in the edge display region. For example, assuming that a preset resolution of a display panel 112 is 1920*1080 and a preset ratio of one edge display region on one side, a center display region, and the other edge display region on the other side is 3:94:3, it represents that an original resolution of each edge display region is approximately 58*1080, and an original resolution of the center display region is approximately 1804*1080. After the edge display pixels are grouped, assuming that the quantity of the effective display pixels in the edge display region is 29, it represents that a resolution of each edge display region is decreased to 29*1080 and a whole resolution of the display panel 112 is decreased to 1862*1080. In the second adjustment solution, when the display panel 112 needs to display an image including 1920*1080 image pixels, the image processing circuit 113 scales down an image including 1920*1080 image pixels according to a new display resolution of 1862*1080, to drive pixel groups in the edge display regions and/or independent edge display pixels in the display panel 112 to display. It can be learned that, content of an edge of a displayed frame is not lost, and an image is not distorted, but an image resolution of the image decreases, resulting in loss of details.

Table 3 shows a whole resolution after the edge display pixels are grouped and a display effect obtained when the image data is adjusted according to the first adjustment solution and the second adjustment solution.

TABLE 3

| | Not adjusted | First adjustment solution | Second adjustment solution |
|---|---|---|---|
| Center display region | Horizontal resolution F | Horizontal resolution F | Horizontal resolution F |
| Edge display region | Horizontal resolution E1 + E2 | Horizontal resolution (E1 + E2) * fP % | Horizontal resolution (E1 + E2) * fP % |
| Whole resolution | Horizontal resolution F + E1 + E2 | Horizontal resolution F + (E1 + E2) * fP % | Horizontal resolution F + (E1 + E2) * fP % |
| Visual effect | An edge of a frame is distorted. | No edge of a frame is distorted and partial content of the edge is lost. | No edge of a frame is distorted, and details of an image are lost. |

fP % is a ratio of the quantity of the effective display pixels to the quantity of the edge display pixels.

Figure 8:
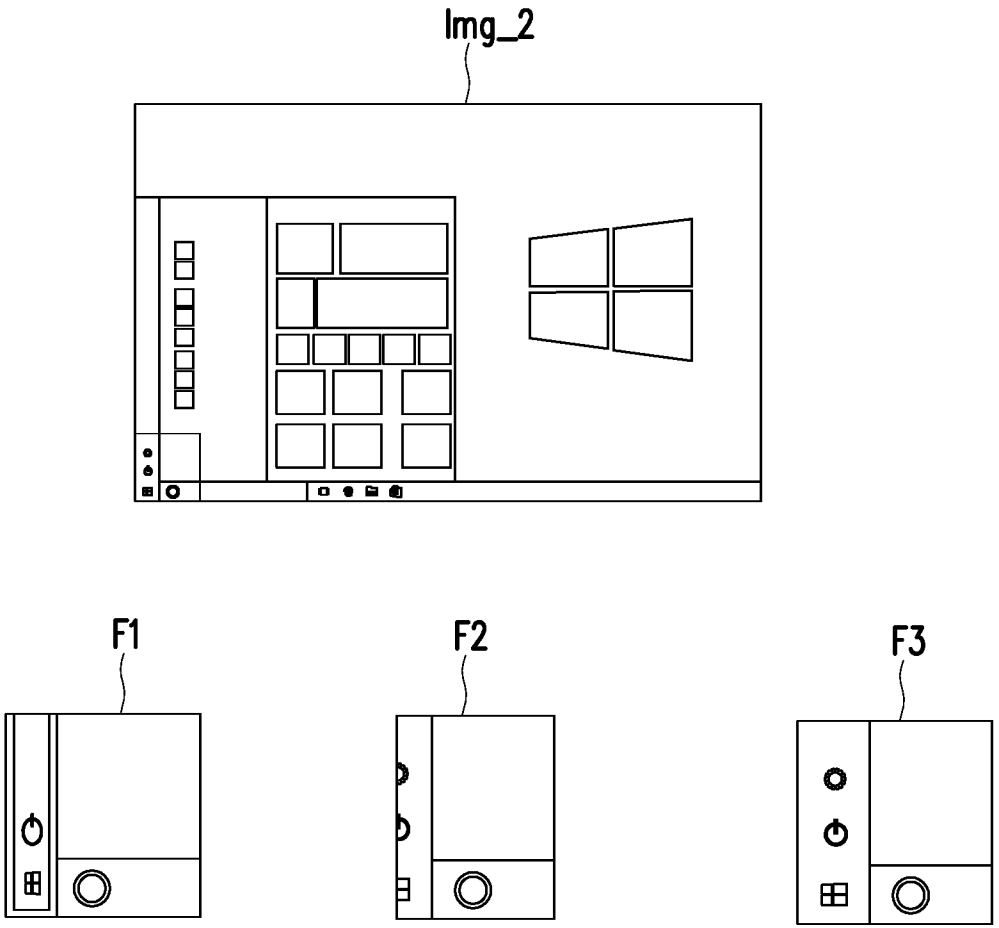
FIG. 8 is a schematic diagram of a locally displayed frame according to an embodiment of the invention.

FIG. 8 is a schematic diagram of a locally displayed frame according to an embodiment of the invention. Referring to FIG. 8, it is assumed that an image Img_2 is original image data. If edge display pixels are not grouped, and the image data is adjusted according to a first adjustment solution or a second adjustment solution, a user views a local frame F1 whose edge is distorted. If the edge display pixels are grouped and the image data is adjusted according to the first adjustment solution, the user views a local frame F2 whereof no edge is distorted, but edge content is lost. If the edge display pixels are grouped, and the image data is adjusted according to the second adjustment solution, the user views a local frame F3 whereof no edge is distorted, but detailed information is lost.

Based on the above, in an embodiment, the processor 120 may determine an appropriate display effect according to displayed content, to control the image processing circuit 113 to adjust the image data according to the first adjustment solution or the second adjustment solution. For example, when the user uses the electronic device 10 to view a multimedia file (for example, a movie or a photo), the processor 120 may control the image processing circuit 113 to adjust the image data according to the first adjustment solution. When the user uses the electronic device 10 to edit a file (for example, a slide or a text file), the processor 120 may control the image processing circuit 113 to adjust the image data according to the second adjustment solution.

To sum up, in the embodiments of the invention, a plurality of edge display pixels in the edge display region of the display panel may be grouped into at least one pixel group, and the edge display pixels in the one or more pixel groups are configured to display a same image pixel. In this way, when a user views, from the front, the display device under the non-flat cover, the user can experience a bezel-less visual effect, and displayed content in the edge display region is not distorted. In addition, the image data is adjusted by using different adjustment solutions, to drive the pixel groups, and a most appropriate display effect is provided according to demands of the user. Based on the above, visual experience of the user in viewing the display device may be improved greatly, so that the invention is also applicable to an application scenario in which displays are spliced.

Although the invention has been disclosed with reference to the foregoing embodiments, the embodiments are not intended to limit the invention. Those of ordinary skill in the art may make variations and improvements without departing from the spirit and scope of the invention. Therefore, the protection scope of the invention should be subject to the appended claims.

What is claimed is:

1. An image display method, adapted for an electronic device comprising a non-flat display surface, wherein a display device of the electronic device is disposed under a non-flat cover, and the method comprises:

grouping a plurality of edge display pixels in an edge display region of the display device into at least one pixel group according to a tilt state of an edge of the non-flat cover, wherein a display panel of the display device comprises the edge display pixels driven by an image processing circuit; and adjusting image data according to a quantity of the at least one pixel group to drive the display panel to display according to the adjusted image data, wherein the edge display pixels in one of the at least one pixel group are configured to display a same image pixel of the adjusted image data, wherein the tilt state of the edge of the non-flat cover comprises a surface tilt angle respectively corresponding to each of the edge display pixels, and the edge display pixels comprise a first edge display pixel and a second edge display pixel, wherein when the surface tilt angle corresponding to the first edge display pixel satisfies a grouping condition, the first edge display pixel and the second edge display pixel adjacent to the first edge display pixel are grouped into the at least one pixel group, and when the surface tilt angle corresponding to the first edge display pixel does not satisfy the grouping condition, the first edge display pixel is not grouped with another edge display pixel.

2. The image display method according to claim 1, wherein the grouping condition comprises that a cosine value of the surface tilt angle corresponding to the first edge display pixel is less than a threshold.

3. The image display method according to claim 2, wherein the edge display pixels further comprise a third edge display pixel adjacent to the second edge display pixel, wherein when a sum of the cosine value of the surface tilt angle corresponding to the first edge display pixel and a cosine value of the surface tilt angle corresponding to the second edge display pixel is less than the threshold, the first edge display pixel, the second edge display pixel adjacent to the first edge display pixel, and the third edge display pixel are grouped into the at least one pixel group.

4. The image display method according to claim 1, wherein the step of adjusting the image data according to the quantity of the at least one pixel group to drive the display panel to display according to the adjusted image data comprises:

when a first adjustment solution is carried out, maintaining an image pixel corresponding to a center display region of the display device in the image data, and compressing, according to a quantity of effective display pixels in the edge display region, an image pixel corresponding to the edge display region of the display device in the image data, wherein a sum of the quantity of the at least one pixel group and a quantity of at least one independent edge display pixel that is not grouped with another edge display pixel in the edge display pixels is the quantity of the effective display pixels.

5. The image display method according to claim 4, wherein the step of adjusting the image data according to the quantity of the at least one pixel group to drive the display panel to display according to the adjusted image data comprises:

when a second adjustment solution is carried out, adjusting a whole image ratio of the image data according to the quantity of the effective display pixels in the edge display region.

6. The image display method according to claim 1, wherein the edge display pixels in the at least one pixel group are driven according to a same RGB pixel value or different RGB pixel values to display a same image pixel.

7. An electronic device having a non-flat display surface, comprising:

a non-flat cover;

a display device, disposed under the non-flat cover and comprising a display panel; and an image processing circuit, coupled to the display panel, and configured to group a plurality of edge display pixels in an edge display region of the display device into at least one pixel group according to a tilt state of an edge of the non-flat cover, wherein the display panel comprises the edge display pixels driven by the image processing circuit, and adjust image data according to a quantity of the at least one pixel group to drive the display panel to display according to the adjusted image data, wherein the edge display pixels in one of the at least one pixel group are configured to display a same image pixel of the adjusted image data, wherein the tilt state of the edge of the non-flat cover comprises a surface tilt angle respectively corresponding to each of the edge display pixels, and the edge display pixels comprise a first edge display pixel and a second edge display pixel, wherein when the surface tilt angle corresponding to the first edge display pixel satisfies a grouping condition, the first edge display pixel and the second edge display pixel adjacent to the first edge display pixel are grouped into the at least one pixel group, and when the surface tilt angle corresponding to the first edge display pixel does not satisfy the grouping condition, the first edge display pixel is not grouped with another edge display pixel.

8. The electronic device according to claim 7, wherein the grouping condition comprises that a cosine value of the surface tilt angle corresponding to the first edge display pixel is less than a threshold.

9. The electronic device according to claim 8, wherein the edge display pixels further comprise a third edge display pixel adjacent to the second edge display pixel, wherein when a sum of the cosine value of the surface tilt angle corresponding to the first edge display pixel and a cosine value of the surface tilt angle corresponding to the second edge display pixel is less than the threshold, the first edge display pixel, the second edge display pixel adjacent to the first edge display pixel, and the third edge display pixel are grouped into the at least one pixel group.

10. The electronic device according to claim 7, wherein when a first adjustment solution is carried out, the image processing circuit maintains an image pixel corresponding to a center display region of the display device in the image data, and compresses, according to a quantity of effective display pixels in the edge display region, an image pixel corresponding to the edge display region of the display device in the image data, wherein a sum of the quantity of the at least one pixel group and a quantity of at least one independent edge display pixel that is not grouped with another edge display pixel in the edge display pixels is the quantity of the effective display pixels.

11. The electronic device according to claim 8, wherein when a second adjustment solution is carried out, the image processing circuit adjusts a whole image ratio of the image data according to a quantity of effective display pixels in the edge display region.

12. The electronic device according to claim 7, wherein the edge of the non-flat cover is a curved surface or a slope.

* * * * *